US007231989B2

(12) United States Patent
Salminen et al.

(10) Patent No.: US 7,231,989 B2
(45) Date of Patent: Jun. 19, 2007

(54) DRILLING CONTROL ARRANGEMENT

(75) Inventors: Pekka Salminen, Nokia (FI); Heikki Saha, Tampere (FI)

(73) Assignee: Sandvik Tamrock Oy, Tampere (FI)

( * ) Notice: Subject to any disclaimer, the term of this patent is extended or adjusted under 35 U.S.C. 154(b) by 0 days.

(21) Appl. No.: 10/713,264

(22) Filed: Nov. 17, 2003

(65) Prior Publication Data

US 2004/0140112 A1 Jul. 22, 2004

Related U.S. Application Data

(63) Continuation of application No. PCT/FI02/00409, filed on May 14, 2002.

(30) Foreign Application Priority Data

May 15, 2001 (FI) ..... 20011021

(51) Int. Cl.
*B25D 1/00* (2006.01)

(52) U.S. Cl. ..... 173/1; 173/2; 173/4; 173/42; 715/765; 715/862

(58) Field of Classification Search ..... 173/1, 173/2, 4, 11, 42, 44, 190, 192; 715/764, 715/765, 856–862, 965
See application file for complete search history.

(56) References Cited

U.S. PATENT DOCUMENTS 4,027,210 A * 5/1977 Weber ..... 318/16
4,195,699 A 4/1980 Rogers et al.
4,521,845 A * 6/1985 Schwefel ..... 700/180
5,060,735 A * 10/1991 .ANG.gren ..... 175/40
5,358,058 A * 10/1994 Edlund et al. ..... 175/24
5,458,207 A * 10/1995 Mattero ..... 175/27
5,474,142 A 12/1995 Bowden
5,679,894 A 10/1997 Kruger et al.
5,713,422 A 2/1998 Dhindsa
5,757,358 A * 5/1998 Osga ..... 715/862
5,803,550 A * 9/1998 Watson et al. ..... 299/13
5,844,133 A * 12/1998 Goto et al. ..... 73/152.54
5,934,387 A * 8/1999 Tuunanen ..... 175/45
6,049,326 A * 4/2000 Beyda et al. ..... 345/157
6,116,819 A * 9/2000 England ..... 405/241
6,186,248 B1 2/2001 Silay et al.

FOREIGN PATENT DOCUMENTS

JP 98 115 171 A 5/1998
WO 0042287 A1 7/2000

* cited by examiner

*Primary Examiner*—Thanh Truong
(74) *Attorney, Agent, or Firm*—Drinker Biddle & Reath LLP

(57) ABSTRACT

A method and a control system for controlling rock drilling. A control unit of a rock drilling apparatus is provided with one or more control modes, each determining the drilling variables to be measured, their threshold values and the operating principles according to which the operating parameters of drilling are controlled to achieve a desired control criterion.

14 Claims, 2 Drawing Sheets

DRILLING CONTROL ARRANGEMENT

This application is a Continuation of International Application PCT/FI02/00409 filed May 14, 2002 which designated the U.S. and was published under PCT Article 21(2) in English.

FIELD OF THE INVENTION

The invention relates to a method of controlling rock drilling, the method comprising drilling rock with a rock drilling apparatus comprising a carrier, a feeding beam, a rock drill movable with respect to the feeding beam, and a control unit for controlling the rock drilling, the method also comprising providing a memory of the control unit with default settings for drilling, measuring the operation of the apparatus during drilling, and adjusting the operating parameters of drilling to accomplish a desired control operation. The invention further relates to a control system for a rock drilling apparatus.

BACKGROUND OF THE INVENTION

Rock drilling utilizes a rock drilling apparatus comprising a carrier, a feeding beam and a rock drill moved with respect to the feeding beam. The rock drill comprises a percussion device for delivering impacts on a tool connected to the drill, and a rotating device for rotating the tool. The rock drill further comprises means for guiding a flushing agent into a drill hole for flushing drill cuttings out of the hole. Operating parameters of rock drilling include impact pressure, feed pressure, rotation pressure medium flow and flushing pressure, which are adjusted in order to control the operation of the drilling apparatus as desired. In a widely used control arrangement the aim is to provide the drill bit with a maximum penetration rate. This arrangement comprises measuring the penetration rate of the drill bit and empirically adjusting individual operating parameters to achieve the highest possible penetration rate. The aim of another generally used control arrangement is to optimize transfer of energy from the drill to the rock. This arrangement comprises measuring the rotation power and/or rotation torque of the drill bit and keeping the variables in predetermined limits by adjusting individual operating parameters.

A disadvantage of the prior art methods is that when the operator is adjusting individual operating parameters, he/she cannot perceive the effect of the adjustment measures to the entire drilling situation and the total costs of drilling. Therefore it is very difficult to optimize drilling by adjusting individual absolute values. Adjustment of a single drilling parameter affects positively certain target criteria representing the success of drilling, but it can simultaneously affect other target criteria negatively. For example, an increase in impact power expedites drilling and thus reduces the costs of drilling, but unfortunately the service life of the drilling equipment simultaneously decreases, which in turn adds considerably to the costs of drilling. In all, in the present systems successful adjustment and control of a drilling situation is highly dependent on the experience and skills of the operator.

SUMMARY OF THE INVENTION

An objective of the present invention is to provide a new and improved arrangement for controlling rock drilling.

The method according to the invention is characterized by providing the control unit with at least two control modes with different control strategies, each control mode determining at least one criterion to be measured during drilling, a threshold value for a measurement result, and at least one adjustable operating parameter, prioritising one control mode over the other modes, and calculating, based on the measurement results, control values for the operating parameters to be adjusted in the control unit in order to automatically control the drilling such that the control strategy of the prioritised control mode is weighted.

Further, the control system according to the invention is characterized in that the user interface of the control unit is provided with at least two preformed control modes, each control mode has a particular control strategy and determines at least one criterion to be measured during the drilling, a threshold value for a measurement result, and at least one adjustable operating parameter, one control mode can be prioritized over the other modes, and the control unit is arranged to automatically adjust, based on the measurement results, the operating parameters determined by the control modes such that the drilling result according to the prioritized control mode is weighted over the other control modes.

According to an essential idea of the invention, a number of control modes with different weighting required to optimize rock drilling are determined in a control unit of a rock drilling apparatus. According to the control strategy of each control mode, one or more critical control criteria are measured and individual operating parameters are adjusted automatically in a manner determined by the control mode in order to achieve a desired state of the control mode. In practice, the control system forms, by means of the control mode, coefficients used to determine allowed limits for measurement results and adjusts individual operating parameters. Default settings of the rock drilling apparatus, which are also required in the control, are stored in advance in the control unit and are taken into account in adjusting the operating parameters.

A criterion to be measured, determined in a control mode, represents the effect of adjusting one or more operating parameters of drilling, this effect being measured either directly by sensors or calculated in the control unit of the rock drilling apparatus from measurement data obtained from the sensors.

The invention has the advantage that the control modes facilitate the control of drilling performed by the operator of the rock drilling apparatus. The control modes clearly describe how an individual control action affects the entire drilling situation. The operator can select the control mode optimising the target criterion that he/she considers the most important. Furthermore, the operator can switch from one control mode to another in a simple manner even during drilling as the circumstances of drilling or the control targets change.

According to an essential idea of an embodiment of the invention, the control unit comprises a user interface, where the control modes are arranged in corners of a plane geometrical polygon. The area defined by the polygon thus determines the available operating area, where the operator can move a control cursor or the like during adjustment. The location of the control cursor in the operating area illustrates the selected operating point. The closer the operating point is to a single corner of the polygon and thus an individual control mode, the greater the importance of the control mode. Due to the geometrical shape of the operating area, transfer of the control cursor closer to a corner moves the operating point further from the other corners and the control modes determined therein. An advantage of this embodiment is that the operator can weight, in a simple manner, a control mode he/she considers to be important. The user interface also clearly shows how prioritising one control mode also affects the other target criteria of drilling. Furthermore, since prioritizing one control mode automatically diminishes the importance of the other modes, the operator cannot give the control system such unreasonable control commands that might conflict with one another and thus cause problems in the operation of the drilling apparatus. In practice, the control unit uses the location of the control cursor to calculate a weighting coefficient for each control mode, and values of the individual operating parameters based on the weighting coefficients.

BRIEF DESCRIPTION OF THE FIGURES

The invention will be described in more detail in the accompanying drawings, in which.

For the sake of clarity, the figures show the invention in a simplified form. Like reference numerals refer to like parts.

DETAILED DESCRIPTION OF THE INVENTION

Figure 1:
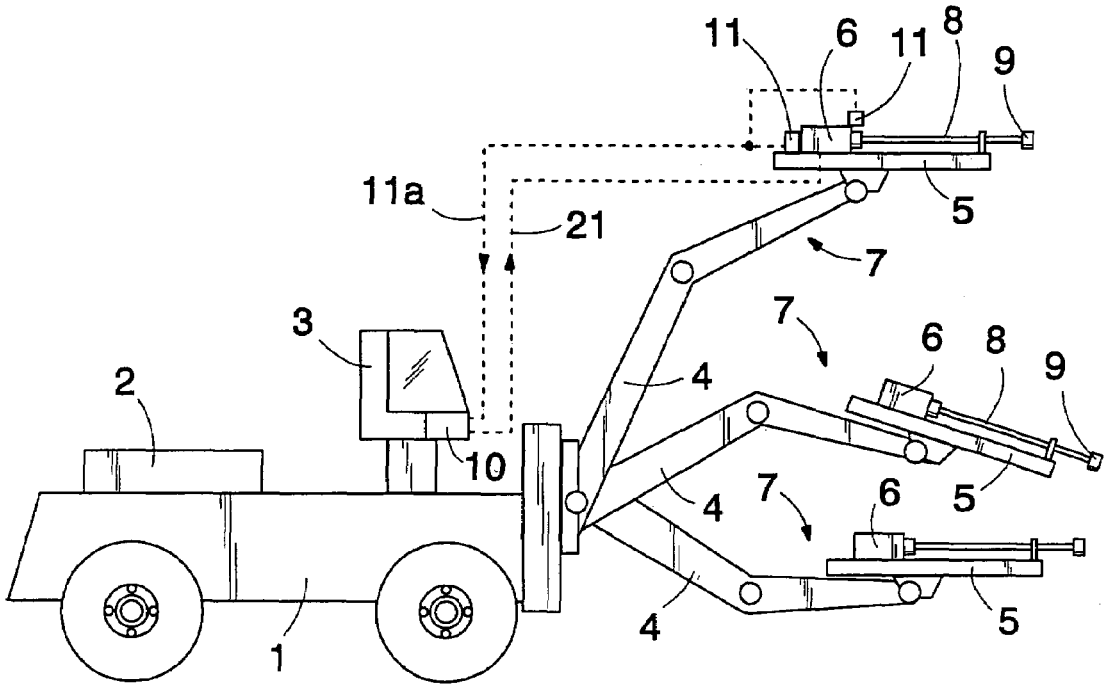
FIG. 1 is a schematic side view of a rock drilling apparatus.

The rock drilling apparatus shown in FIG. 1 comprises a carrier 1, a power unit 2 arranged on the carrier, a control cabin 3 and in this case three drilling booms 4 that are movable with respect to the carrier. The free end of each drilling boom 4 is provided with a feeding beam 5 with a rock drill 6 arranged movably therein. The rock drill 6, the feeding beam 5 and the drilling boom 4 form a unit referred to herein as a drilling unit 7. For the sake of clarity, FIG. 1 does not show any accessory equipment required for drilling, such as devices related to replacement of drill rods 8 and a drill bit 9. The rock drilling apparatus further comprises a control unit 10 arranged on the carrier 1, preferably in the control cabin in connection with the equipment for controlling the rock drilling apparatus. The control unit 10 receives measurement data on e.g. impact pressure, feed pressure, feed flow, feed rate, rate of rotation, rotation pressure, rotation pressure medium flow, flow of flushing agent, sound pressure intensity, and vibration via a line 11*a* from sensors 11 arranged in the drilling units 7. The control unit transmits control commands via a control line 21 to the drilling units 7 to control them.

Figure 2:
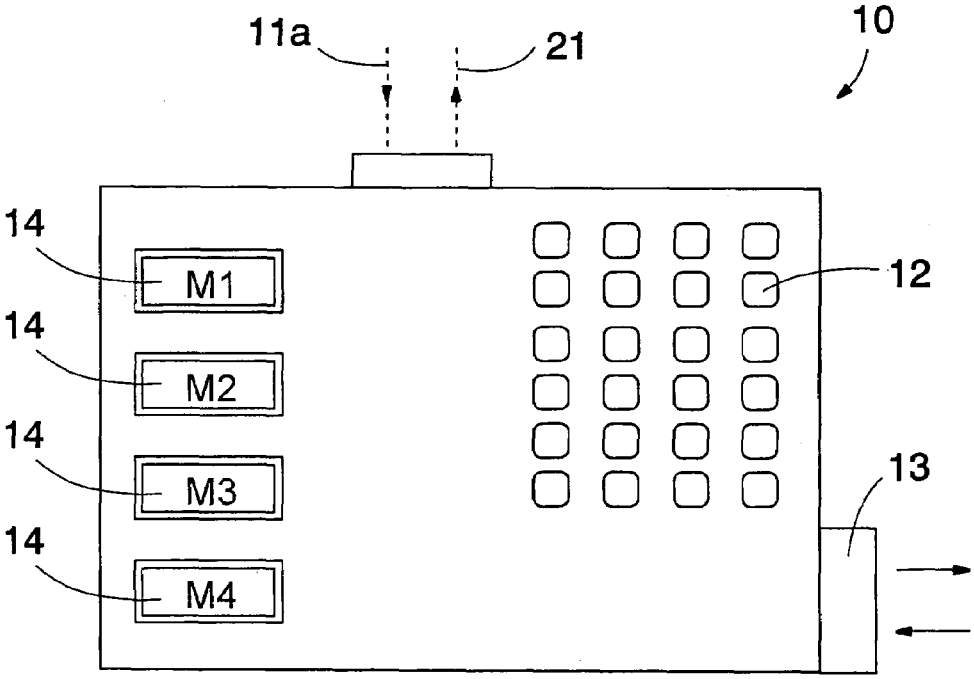
FIG. 2 shows schematically a control unit according to the invention and a user interface thereof.

FIG. 2 shows a control unit 10 of a rock drilling apparatus. The control unit 10 may comprise a keypad 12 for inputting data into the memory of the control unit. For example the default settings of the drilling equipment, such as data about the drill, drill rods, drill bit etc., can be supplied via the keypad to the control unit. Alternatively, the default settings can be read by a suitable reading device 13 for example from a memory disc or transferred from a unit outside the rock drilling apparatus via a wired or a wireless data transmission connection. The control unit shown in the FIG. 2 comprises four control modes M1–M4, and the desired control mode can be selected by means of selecting switches 14. In this case the operator selects one control mode at a time, the control strategy of the control mode being used by the control unit to control the drilling.

The control modes M1–M4 shown in FIG. 2 can be determined e.g. according to the following control strategies:

M1=drilling efficiency mode that measures the rate at which the drill tool penetrates the rock. The drilling efficiency mode M1 comprises adjusting the operating parameters to obtain a maximum penetration rate. Therefore the target criterion is the maximum penetration rate. Alternatively, the target criterion of the drilling efficiency mode can be drilling at a substantially constant penetration rate. The control unit adjusts the penetration rate e.g. by varying the feed force, impact power and rotation torque.

M2=quality mode, which measures e.g. the rotation torque acting on the drill tool. The quality mode M2 comprises adjusting the operating parameters so that the rotation torque remains within predetermined limits. It is also possible to measure the feed force and to adjust the feeding so as to avoid overfeed during the drilling, since this usually makes the hole to be drilled less straight. Sufficient straightness of a hole, which can be one of the target criteria of the quality mode, is obtained by using a low impact power. One of the characteristics illustrating the quality of drilling can be the ease of unscrewing the threaded connections between the drilling components. The connections can be opened more easily when overfeed is avoided during the drilling.

M3=cost mode that measures e.g. vibration occurring in the drilling equipment. The cost mode M3 comprises adjusting the operating parameters so as to minimize the vibration. The cost mode determines limits for allowed vibrations. Diminishing vibration lengthens the service life of the drilling equipment, thus minimizing costs of spare parts, and idle time resulting from repairs. The target criterion of this mode is the service life of the drilling equipment. In order to minimize vibration, the aim is to avoid both underfeed and overfeed, and a high impact power and rotation torque during the drilling.

M4=optimisation mode, where the control until automatically adjusts the operating parameters one at a time. The mode comprises measuring a change in the measuring values caused by the operating parameter that is being adjusted. Measuring values have preset limits. When adjustment of an individual operating parameter provides the allowed area preset for a measuring value, this adjustment value is locked and a new operating parameter is selected and adjusted to obtain the allowed area preset for the measuring value. The adjustment is continued in this manner as a continuous cycle.

Fulfilment of the target criteria requires fulfillment of certain measurable criteria.

Figure 3:
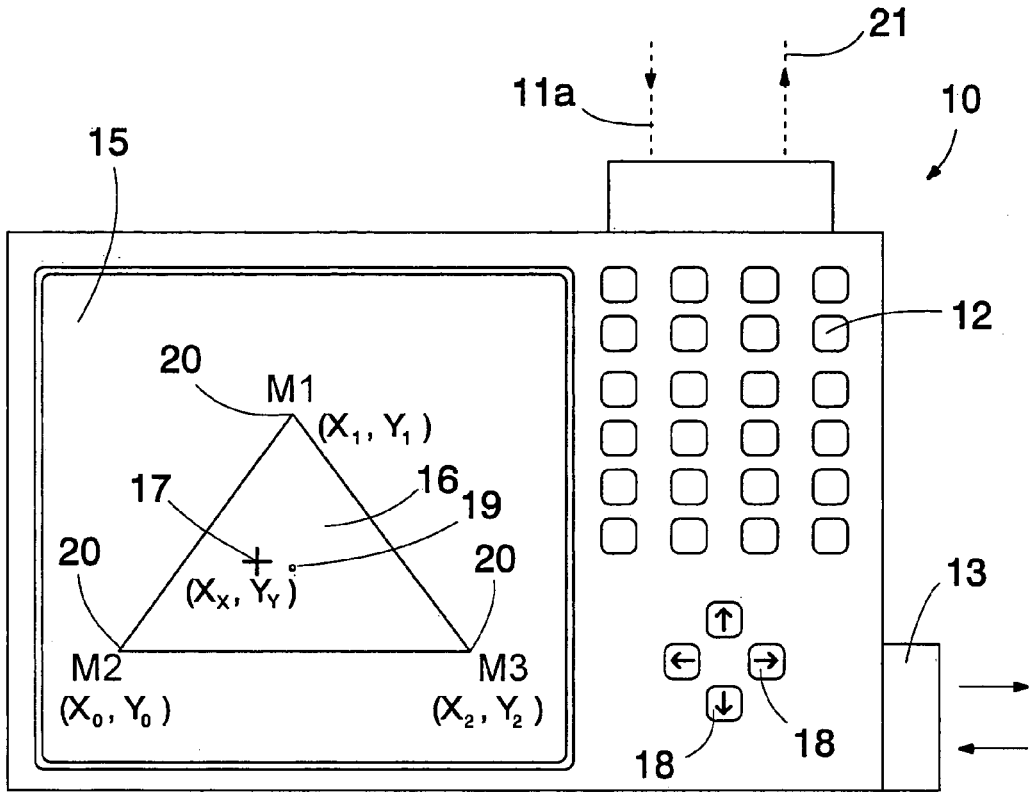
FIG. 3 shows schematically another control unit according to the invention and a user interface thereof.

FIG. 3 shows another control unit 10, which may comprise a keypad 12 and a reading device 13 for supplying default data to the control unit. The control unit may further comprise a screen 15 and a graphical user interface. The screen 15 may display a polygonal operating area 16 that defines the area where a control cursor 17 can be moved by means of arrow keys 18. Alternatively, the cursor can be moved with other guides, such as a mouse, a pointing ball or a touch screen. The location of the control cursor 17 in the operating area 16 determines the current operating point of the control system. In this case the operating area 16 is triangular, and each corner 20 of the triangle represents one control mode. The triangle has three control modes: M1, M2 and M3. By moving the control cursor 17 the operator can weight one control mode over the other two modes. In a situation where the control cursor 17 is placed in the centre 19 of the triangle, the distance to each corner 20 is equal and each control mode is thus equally weighted. When the control cursor 17 is moved towards one corner 20, the distance thereto decreases while the distance to the other two corners of the triangle increases. The control system may calculate the weighting of the control modes M1, M2 and M3 with respect to the distance from the cursor 17 to the corners 20 of the triangle.

Weighting coefficients used by the control system can be determined as follows:

calculating the maximum distance R of the cursor by formula $$R=Sqrt((X1-X0)^2+(Y1-Y0)^2)$$

calculating weighting coefficients C0, C1, C2 by subtracting the direct distance to the corner from the maximum distance R $$C0=R-Sqrt((XX-X0)^2+(YY-Y0)^2)$$

$$C1=R-Sqrt((XX-X1)^2+(Y1-YY)^2)$$

$$C2=R-Sqrt((X2-XX)^2+(YY-Y2)^2),$$

followed by calculating limits for the measurement data, and control values of individual operating parameters by means of the weighting coefficients C0, C1, C2.

Furthermore, the graphical user interface enables the operator to select the desired control modes M1–M3 to the corners 20 of the operating area 16 from the memory of the control unit 10. Also, the control unit can store different operating areas 16, from which the operator can choose one.

Figure 4:
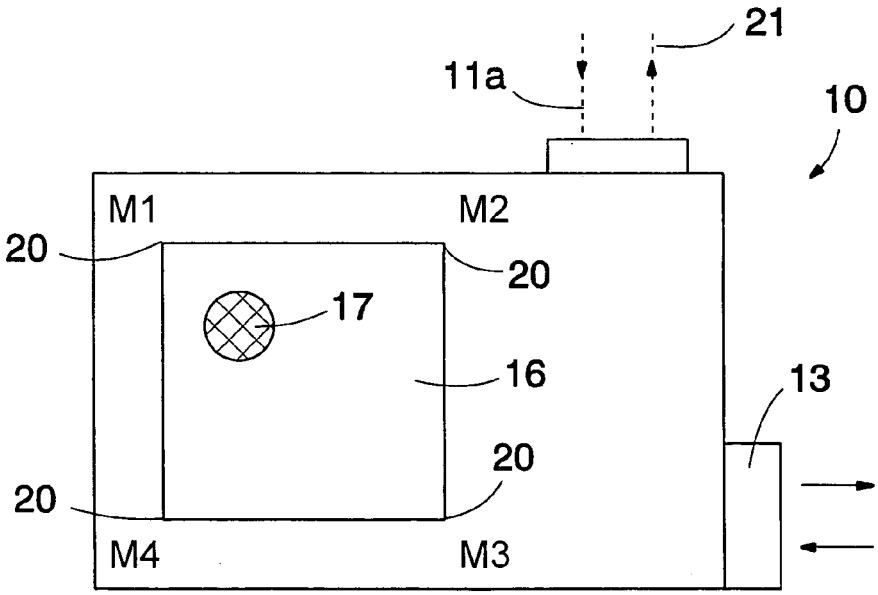
FIG. 4 shows schematically a third control unit according to the invention and a user interface thereof.

FIG. 4 shows yet another control unit 10, where four control modes M1, M2, M3 and M4 are arranged in a square. In this case the control cursor 17 is a mechanical guide, such as a joystick or the like, the location of the guide within the square operating area 16 determining the operating point of the control system. Similarly as in the arrangement shown in FIG. 3, the control system utilizes the distance between the cursor and an individual control mode to calculate, for each control mode, the weighting coefficients corresponding to the operating point, and it thereafter calculates the operating parameters for the drilling by means of the coefficients.

Operating areas 16 of other shapes are also possible, depending on the number of the control modes to be used, for instance. In the simplest form the operating area can be a line segment, where two control modes are arranged at the end points of the line segment. Moving the control cursor towards one end point of the line segment simultaneously lengthens the distance to the other end point, thus decreasing the weighting of the control mode at the other end point.

It should further be mentioned that the criterion to be measured, mentioned in the control mode, can be e.g. the noise of drilling, state of motion of the shank, temperature of the drilling equipment, or strain of the drill rod, in addition to the criteria disclosed above.

When the rock drill and/or the feed means are operated by a pressurized medium, the pressure and flow of the pressurized medium acting on the equipment may be measured. Correspondingly, the operating parameters may include impact pressure, feed pressure, feed flow, rotation pressure, rotation flow, and pressure and flow of the flushing agent. On the other hand, when the drilling equipment is operated electrically, the sensors may measure electrical values, such as voltage and current. Correspondingly, when the equipment is electrical, the operating parameters may be electrical control variables.

The drawings and the related description are only intended to illustrate the inventive idea. The details of the invention can vary within the scope of the claims. Therefore the invention can be applied in all types of rock drilling.

What is claimed is:

1. A method of controlling rock drilling, the method comprising:

drilling rock with a rock drilling apparatus including a carrier, a feeding beam, a rock drill movable with respect to the feeding beam, and a control unit for controlling the rock drilling, and the rock drilling having adjustable operating parameters including at least one of impact power, impact pressure, feed force, feed pressure, feed flow, feed rate, rotation torque, rate of rotation, rotation pressure, rotation flow, flushing pressure, and flushing flow, providing a memory of the control unit with default settings for drilling, measuring an operation of the apparatus during drilling, and adjusting at least one operating parameter of drilling to accomplish a desired control operation, said adjusting step including:

providing an operating system of the control unit with at least two simultaneously active control modes with different control strategies, each control mode determining at least one target criterion to be measured during drilling, a threshold value for a measurement result of said at least one target criterion, and at least one adjustable operating parameter, prioritizing one control mode over the other control modes such that an affect of the prioritized control mode increases and simultaneously affects of the other control modes diminish, and calculating, based on the measurement results of said at least one target criterion, control values for the operating parameters to be adjusted in the control unit in order to automatically control the drilling such that the control strategy of the prioritized control mode is weighted relative to the other control modes.

2. A method according to claim 1, comprising:

providing the control unit with a user interface, arranging an operating area of the shape of a plane geometrical polygon in the user interface, selecting the operating point of the control by moving a control cursor in the operating area, placing one control mode in each corner of the operating area, and calculating a weighting coefficient for each control mode by means of the distance between the operating point and the corners.

3. A rock drilling apparatus comprising:

a carrier, a feeding beam, a rock drill movable with respect to the feeding beam, and a control system including:

a control unit provided with a user interface for controlling the drilling, at least one sensor for measuring drilling operation, and an operating system for the control unit, wherein the operating system is provided with at least two simultaneously active preformed control modes with different control strategies, and wherein each control mode determines at least one target criterion to be measured during the drilling, a threshold value for a measurement result of said at least one target criterion, and at least one adjustable operating parameter, wherein one control mode can be prioritized over the other control modes such that an affect of the prioritized control mode increases and simultaneously affects of the other control modes diminish, and the control unit is arranged to automatically adjust, based on the measurement results of said at least one target criterion, the operating parameters determined by the control modes such that the drilling result according to the prioritized control mode is weighted over the other control modes.

4. A rock drilling apparatus according to claim 3, wherein the user interface of the control unit includes an operating area of the shape of a plane geometrical polygon, one control mode is placed in each corner of the polygon, the user interface includes a control cursor whose location in the operating area is arranged to represent the currently selected operating point of the control, and the control unit is arranged to calculate the weighting of each control mode depending on the distance from the operating point to the corners of the polygon.

5. A rock drilling apparatus according to claim 4, wherein the operating system includes a triangular operating area.

6. A rock drilling apparatus according to claim 5, wherein the first corner of the triangular operating area is provided with a control mode optimizing the penetration rate of the drilling, the second corner of the triangle is provided with a control mode optimizing the straightness of the hole to be drilled, and the third corner of the triangle is provided with a control mode optimizing the service life of the drilling equipment.

7. A rock drilling apparatus according to claim 3, wherein the control unit includes a graphical user interface.

8. A method of controlling rock drilling, the method comprising:

drilling rock with a rock drilling apparatus including a carrier, a feeding beam, a rock drill movable with respect to the feeding beam, and a control unit for controlling the rock drilling, providing a memory of the control unit with default settings for drilling, measuring an operation of the apparatus during drilling, and adjusting at least one operating parameter of drilling to accomplish a desired control operation, said adjusting step including:

providing an operating system of the control unit with at least two simultaneously active control modes with different control strategies, each control mode determining at least one target criterion to be measured during drilling, a threshold value for a measurement result of said at least one target criterion, and at least one adjustable operating parameter, the at least two simultaneously active control modes being at least two of a control mode to optimize a penetration rate of drilling, a control mode to optimize the straightness of a drill hole, a control mode to optimize the service life of drilling equipment, a control mode to ease unscrewing threaded connections between drilling components, and a control mode to minimize vibration occurring in the rock drilling apparatus, prioritizing one control mode over the other control modes such that an affect of the prioritized control mode increases and simultaneously affects of the other control modes diminish, and calculating, based on the measurement results of said at least one target criterion, control values for the operating parameters to be adjusted in the control unit in order to automatically control the drilling such that the control strategy of the prioritized control mode is weighted relative to the other control modes.

9. A method of controlling rock drilling, the method comprising:

drilling rock with a rock drilling apparatus including a carrier, a feeding beam, a rock drill movable with respect to the feeding beam, and a control unit including a user interface and a memory with default settings for drilling, controlling the rock drilling with the control unit, including:

arranging an operating area of the shape of a plane geometrical polygon in the user interface, selecting the operating point of the control by moving a control cursor in the operating area, placing one control mode in each corner of the operating area, and calculating a weighting coefficient for each control mode by means of the distance between the operating point and the corners, measuring an operation of the apparatus during drilling, and adjusting at least one operating parameter of drilling to accomplish a desired control operation, said adjusting step including:

providing an operating system of the control unit with at least two simultaneously active control modes with different control strategies, each control mode determining at least one target criterion to be measured during drilling, a threshold value for a measurement result of said at least one target criterion, and at least one adjustable operating parameter, prioritizing one control mode over the other control modes, and calculating, based on the measurement results of said at least onr target criterion, control values for the operating parameters to be adjusted in the control unit in order to automatically control the drilling such that the control strategy of the prioritized control mode is weighted relative to the other control modes.

10. A control system for a rock drilling apparatus comprising:

a carrier, a feeding beam, a rock drill movable with respect to the feeding beam, at least one sensor for measuring drilling operation, a control unit including:

an operating system including at least two simultaneously active preformed control modes with different control strategies, and wherein each control mode determines at least one target criterion to be measured during the drilling, a threshold value for a measurement result of said at least one target criterion, and at least one adjustable operating parameter, wherein one control mode can be prioritized over the other control modes, and a user interface for controlling the drilling, the user interface including:

an operating area of the shape of a plane geometrical polygon, one control mode is placed in each corner of the polygon, the user interface includes a control cursor whose location in the operating area is arranged to represent the currently selected operating point of the control, and the control unit is arranged to calculate the weighting of each control mode depending on the distance from the operating point to the corners of the polygon, wherein the control unit is arranged to automatically adjust, based on the measurement results of said at least one target criterion, the operating parameters determined by the control modes such that the drilling result according to the prioritized control mode is weighted over the other control modes.

11. A control system according to claim 10, wherein the operating system includes a triangular operating area.

12. A control system according to claim 11, wherein the first corner of the triangular operating area is provided with a control mode optimizing the penetration rate of the drilling, the second corner of the triangle is provided with a control mode optimizing the straightness of the hole to be drilled, and the third corner of the triangle is provided with a control mode optimizing the service life of the drilling equipment.

13. A control system for a rock drilling apparatus comprising:

a carrier, a feeding beam, a rock drill movable with respect to the feeding beam, at least one sensor for measuring drilling operation, a control unit including an operating system including at least two simultaneously active preformed control modes with different control strategies, and wherein each control mode determines at least one target criterion to be measured during the drilling, a threshold value for a measurement result of said at least one target criterion, and at least one adjustable operating parameter, wherein one control mode can be prioritized over the other control modes, and a user interface for controlling the drilling, the user interface including:

an operating area of the shape of a line segment, two control modes are arranged at first and second end points of the line segment, and a control cursor whose location on the line segment is arranged to represent the currently selected operating point of the control, wherein the control unit is arranged to calculate the weighting of the two control modes depending on the distance from the operating point to the first and second end points of the line segment, wherein the control unit is arranged to automatically adjust, based on the measurement results of said at least one target criterion, the operating parameters determined by the control modes such that the drilling result according to the prioritized control mode is weighted over the other control modes.

14. A control system for a rock drilling apparatus comprising:

a carrier, a feeding beam, a rock drill movable with respect to the feeding beam, at least one sensor for measuring drilling operation, a control unit including:

a user interface for controlling the drilling, an operating system including at least two simultaneously active preformed control modes with different control strategies, the at least two simultaneously active control modes being at least two of a drilling efficiency mode, a quality mode, and a cost mode, and wherein each control mode determines at least one target criterion to be measured during the drilling, a threshold value for a measurement result of said at least one target criterion, and at least one adjustable operating parameter, wherein one control mode can be prioritized over the other control modes, and wherein the control unit is arranged to automatically adjust, based on the measurement results of said at least one target criterion, the operating parameters determined by the control modes such that the drilling result according to the prioritized control mode is weighted over the other control modes.

* * * * *